United States Patent [19]

Csutor

[11] 4,066,990

[45] Jan. 3, 1978

[54] ELECTRIC CIRCUIT BREAKER

[75] Inventor: Endre Csutor, Ludenscheid, Germany

[73] Assignee: Brown, Boveri & Cie, A.G., Mannheim, Germany

[21] Appl. No.: 696,069

[22] Filed: June 14, 1976

[30] Foreign Application Priority Data

June 26, 1975 Germany ..... 2528481

[51] Int. Cl.[2] ..... H01H 71/58

[52] U.S. Cl. ..... 335/174; 335/191; 200/153 G

[58] Field of Search ..... 200/153 G, 153 H; 335/21, 22, 38, 169, 173, 174, 189, 190, 191; 337/59, 63, 64, 70, 75

[56] References Cited

U.S. PATENT DOCUMENTS

| | | | |
|---|---|---|---|
| 2,961,513 | 11/1960 | Wood | 337/75 X |
| 3,217,125 | 11/1965 | Brackett | 337/75 X |
| 3,454,918 | 7/1969 | Brackett | 337/59 X |

*Primary Examiner*—A. D. Pellinen
*Attorney, Agent, or Firm*—Erwin Salzer

[57] ABSTRACT

A circuit breaker which is characterized by its simplicity and the reduction of its parts. The direction of its manual operation and the direction of the movement of its contacts are at right angles. The contact operating mechanism and the latching mechanism interact by abutment of an overdrawn over-center toggle link with the latch lever of the device.

4 Claims, 5 Drawing Figures

FIG. 1
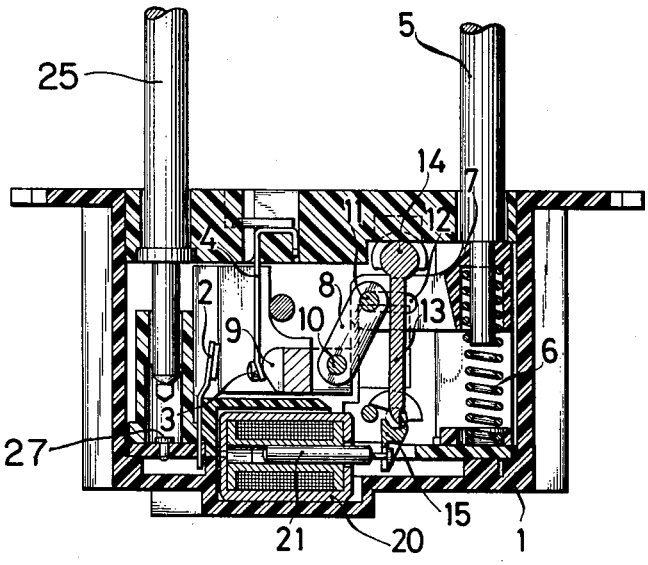
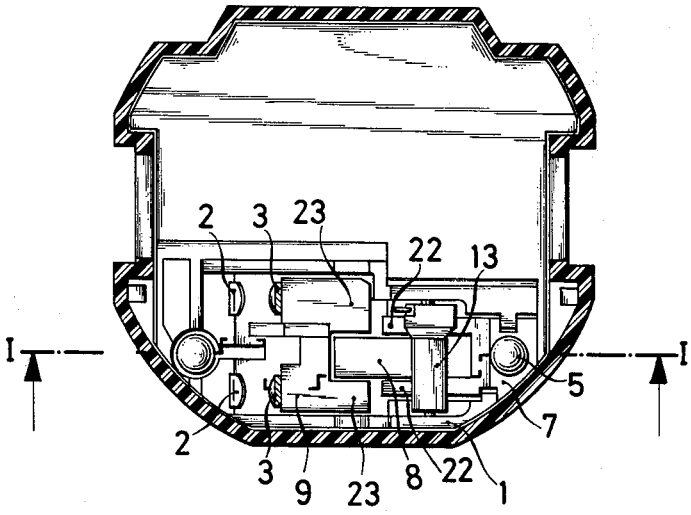
FIG. 2

FIG. 3
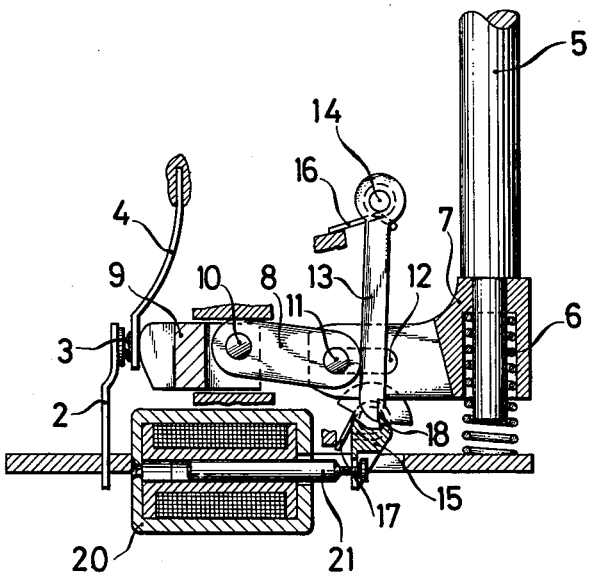
FIG. 4
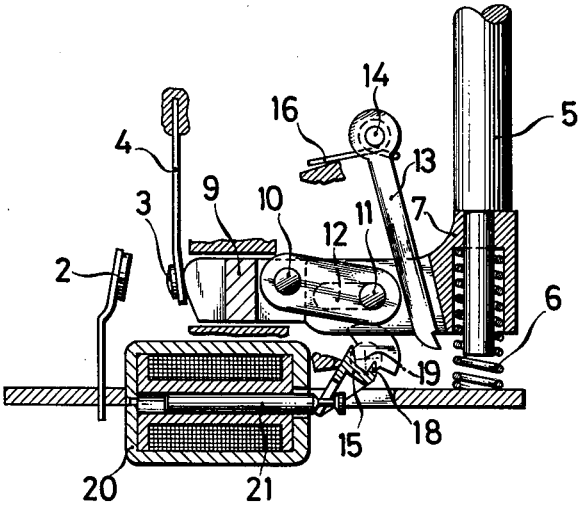
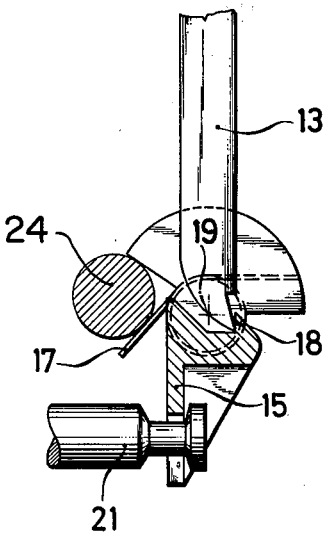
FIG. 5

ELECTRIC CIRCUIT BREAKER

BACKGROUND OF THE INVENTION

There are prior art or known circuit breakers of the type wherein the direction of manual operation and that of the movement of the movable contacts of the breaker are at right angles. The circuit breakers were relatively complex and it is the prime object of the present invention to simplify prior art designs of the aforementioned character.

SUMMARY OF THE INVENTION

This invention relates to circuit breakers with manual and automatic tripping means. The breaker has a contact-operating lever held in the circuit-closed position against spring bias by means of an overdrawn over-center linkage. Said linkage is held in position by a latch mechanism including a latch lever and acted upon by the tripping means of the breaker to unlatch said latch means.

The overdrawn over-center linkage includes a toggle lever having one end affixed pivotally to a first slide member. The other end of said toggle lever is affixed to a second slide member and is movable by an operating handle at right angles to said first slide member. The end of the toggle lever is joined to said second slide member by a pin slidable in a groove and abuts against said latch lever.

BRIEF DESCRIPTION OF THE DRAWINGS

FIG. 1 is generally a vertical section through the breaker taken along I—I of FIG. 2 and showing some parts in elevation rather than sectionalized;

FIG. 2 is a top-plan view of the breaker with sectionalized breaker housing;

FIG. 3 is a sectionalized view of the principal parts of the structure of FIG. 1 showing the contacts in the closed position thereof;

FIG. 4 is a sectionalized view of the principal parts of the structure of FIG. 1 showing the contacts in the open position following a trip-free operation of the mechanism; and FIG. 5 is a representation of the latching mechanism on a larger scale.

DESCRIPTION OF PREFERRED EMBODIMENT

In the drawings reference numeral 1 has been applied to indicate the housing for all the parts of the breaker. The stationary contacts have been indicated by reference numeral 2 and the cooperating movable contact by reference numeral 3. The movable contacts 3 are supported by spring arms 4. Reference numeral 5 has been applied to indicate the manual operating rod that can be depressed against the bias of spring 6. Operating rod 5 moves a transverse arm 7 which is pivotally connected to a toggle lever 8. This pivotal connection involves the slot or groove 12 in arm 7 and the pin 11 movable inside of slot or groove 12. The end of toggle lever 8 remote from arm 7 is pivoted at 10 to a slidable member 9. Slidable member 9 is guided by a member approximately at right angles to the portion of springs 4 which support the movable contact 3. Toggle lever 8 rests with the right end thereof against a latch lever 13 which is pivoted at 14 and whose lower end is engaged by latch member 15. Latch member 15 is under the action of tripping means. These tripping means may consist of a solenoid 20 and a plunger 21. As an alternative, a thermal tripping means may operate latch member 15, or both electromagnetic and thermal tripping means may be provided. The latch member 15 may be pivoted about point 19 and is under the action of a spring 17. The latter causes engagement of latch member 15 with an abutment 24 and thus so positions latch member 15 as to latch with the nose 18 on lever 13 under the action of spring 16. The point of which lever 13 engages latch member 15 is positioned in such a way with respect to point 19 as to establish a great mechanical advantage for rod 21 of tripping coil 20. Hence the forces required to trip the breaker are minimized.

The toggle member 8 is arranged between fork-shaped projections 22 of transverse arm or second slide member 7 and fork-shaped projections 23 of the first slide member 9 (See FIG. 2). The lever 13 is arranged between the fork-shaped projections 22 of the transverse arm or second slide member 7 and the parts 22 are shaped in such a fashion, that lever 13 has the play needed by it to release the breaker.

Closing of the breaker is effected by depressing manual operating rod 5 against the action of spring 6. As a result, the right end of toggle 8 abuts against lever 13 and the left end of toggle 8 moves slide member 9 from right to left, i.e. into the position shown in FIG. 3. This causes engagement of the fixed contacts 2 by the movable contacts 3.

During the above operation toggle lever 8 and the left portion of slide member 7 are caused to form an overdrawn toggle 10,11 12. Hence contact 3 is restrained in engagement with contact 2.

Automatic opening results in a movement of plunger 21 from right to left, and freeing of latch lever 13 by latch lever 15. Now the forces of springs 4 supporting contacts 3 move slide member 9 and toggle lever 8 from left to right, as shown in FIG. 4. This movement is made possible by the oblong hole 12 in slide member 7 which assures trip-free operation of the device. The movement of contacts 3 from left to right is made possible by the fact that the forces of springs 4 by far exceed those of spring 16 acting upon lever 13.

Following release of the latch between parts 13 and 15, spring 6 moves the second slide member 7 back to its initial position. This, in turn, causes levers 13 and 15 to assume their initial latched positions under the action of springs 16 and 17.

Rod 5 may be substituted by another manual operating member such as a push button, a rocker, or the like. Manual opening may be effected by means (not shown) acting upon lever 15 and moving the same in the same way as the electromagnetic tripping means. If the switch is being used as earth leakage disconnect, the manual operating means is used as sensing key, by means of which the contact elements 25 and 27 may be short-circuited which, in turn, energize the tripping means 20 to effect automatic tripping.

I claim as my invention:

1. A circuit breaker with manually and automatic tripping means having a contact-operating lever held in the circuit-closed position against spring bias by means of an overdrawn over-center linkage, said linkage being held in position by a latch mechanism including a latch lever and acted upon by the tripping means of the breaker to unlatch said latch mechanism, wherein the improvement comprises in that a. said overdrawn over-center linkage consists of a single toggle lever (8) having one end (10) pivotally affixed to a first straight path slide member (9), the other end of said toggle lever (8) being affixed to a second straight path slide member (7) and movable by an operating handle in a direction at right angles to said first straight path slide member (9);

b. the end of said toggle lever (8) being joined to said second straight path slide member (7) by a pin (11) slidable in an oblong hole (12) and abutting against a first latch lever (13); and c. wherein said first latch lever (13) is in latching engagement with a cooperating second latch lever (15) under the action of tripping means (20,21), both said first latch lever (13) and said cooperating second latch lever (15) being under the action of spring means (16,17) tending to oppose unlatching thereof.

2. A circuit breaker as specified in claim 1 wherein said toggle lever (8) is pivoted between fork-shaped projections (22,23) of said two slide members (7,9).

3. A circuit breaker as specified in claim 2 wherein said second slide member (7) is movable against spring bias (6) and wherein said fork-shaped projections (22) are shaped in such a way that the latch lever (13) has sufficient space to perform its trajectory following unlatching thereof.

4. A circuit breaker as specified in claim 3 wherein said latch lever (13) is in latching engagement with a cooperating latch lever (15) under the action of tripping means (20,21), and wherein both said latch lever (13) and said cooperating latch lever (15) are under the action of spring means (16,17) tending to oppose unlatching thereof.

* * * * *